US006830591B1

(12) United States Patent
Wang et al.

(10) Patent No.: US 6,830,591 B1
(45) Date of Patent: Dec. 14, 2004

(54) METHOD FOR THE USE OF HYDROPHOBIC BLEACHING SYSTEMS IN TEXTILE PREPARATION

(75) Inventors: Jiping Wang, West Chester, OH (US); Nodie Monroe Washington, Wilberforce, OH (US); Kevin David Moe, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 222 days.

(21) Appl. No.: 09/784,541

(22) Filed: Feb. 15, 2001

Related U.S. Application Data

(60) Provisional application No. 60/182,702, filed on Feb. 15, 2000.

(51) Int. Cl.[7] ..... D06L 3/02

(52) U.S. Cl. ..... 8/111; 8/101; 510/276; 510/286; 510/302; 510/362; 510/372; 510/375

(58) Field of Search ..... 8/101, 111; 510/276, 510/286, 302, 362, 372, 375, 367

(56) References Cited

U.S. PATENT DOCUMENTS

| | | | | | |
|---|---|---|---|---|---|
| 4,483,778 | A | * | 11/1984 | Thompson et al. | 252/94 |
| 4,539,007 | A | | 9/1985 | Rösch et al. | |
| 5,106,528 | A | * | 4/1992 | Francis et al. | 252/186.23 |
| 5,405,412 | A | * | 4/1995 | Willey et al. | 8/111 |
| 5,419,847 | A | * | 5/1995 | Showell et al. | 252/100 |
| 5,527,362 | A | * | 6/1996 | Cole et al. | 8/111 |
| 5,833,719 | A | * | 11/1998 | Francois et al. | 8/111 |
| 5,840,667 | A | | 11/1998 | Milne et al. | |
| 5,885,303 | A | | 3/1999 | Payet | |
| 6,096,097 | A | * | 8/2000 | Kummeler et al. | 8/111 |
| 6,569,209 | B2 | * | 5/2003 | Wang et al. | 8/111 |

FOREIGN PATENT DOCUMENTS

| | | | |
|---|---|---|---|
| EP | 0 360 383 A2 | | 3/1990 |
| EP | 0 584 710 A2 | | 3/1994 |
| GB | 1 392 981 | | 4/1972 |
| WO | 94/28106 | * | 12/1994 |
| WO | WO 94/28106 | | 12/1994 |
| WO | WO 95/21283 | | 8/1995 |
| WO | 95/21283 | * | 8/1995 |

OTHER PUBLICATIONS

U. Denter et al., Peressigsäure in der Textilveredlung, Apr. 1996, 50–55.

Scarborough et al., The Use Of Tetra Acetyl Ethylene Diamine (T.A.E.D) In The Bleaching Of Mixed Fibre Blends To Improve Fibre Quality, 290–298.

* cited by examiner

*Primary Examiner*—Charles Boyer
(74) *Attorney, Agent, or Firm*—Brahm J. Corstanje; Brian M. Bolam; Kim William Zerby

(57) ABSTRACT

A method for the treatment of a non-finished textile component is provided. The method comprises the steps of treating a non-finished textile component in an aqueous bleaching solution of hydrogen and a hydrophobic bleach activator or hydrophobic peracid. Preferred bleach activators include the alkanoyloxybenzene sulfonates and in particular noanoyloxybenzene sulfonate. The method provides superior fiber protection and fabric strength benefits versus conventional processing as well as significant savings in both energy and time due to the lower bleaching temperatures.

32 Claims, No Drawings

METHOD FOR THE USE OF HYDROPHOBIC BLEACHING SYSTEMS IN TEXTILE PREPARATION

CROSS REFERENCE TO RELATED APPLICATIONS

This application claims priority under 37 U.S.C. §119(e) to U. S. Provisional Application Serial No. 60/182,702, filed Feb. 15, 2000.

TECHNICAL FIELD

The present invention relates to the use of hydrophobic bleaching systems in textile preparation and, more particularly, to the use of activated peroxide bleaching via hydrophobic activators or hydrophobic peracids on woven or knitted fabrics, fibers or yarns.

BACKGROUND OF THE INVENTION

In the textile processing of natural fibers, yarns and fabrics, a pretreatment or preparation step is typically required to properly prepare the natural materials for further use and in particular for the dyeing and/or finishing stages typically required for commercial goods. These textile treatment steps remove impurities and color bodies, either naturally existing or those added by the spinning and weaving steps to the fibers and/or fabrics.

While textile treatments may include a number of varying treatments and stages, the most common include: singeing—the removal of loose or miscellaneous fibers from the surface by burning with a flame; de-sizing—the removal of sizing agents, such as starches, via enzymatic soaking; scouring—the removal of greases, oils, waxes and fats by contact with a solution of sodium hydroxide at temperatures near boiling; mercerization—the application of high levels of sodium hydroxide in conjunction with stretching and pulling of the fabrics for increased fiber strength.

An additional common pretreatment step involves a bleaching step to destroy naturally occurring color bodies. The bleaching step provides a uniform white appearance for consumer acceptable whites as well as provides a uniform color base for dyeing or printing. Thus, a highly successful bleaching step is necessary for commercially acceptable consumer fabrics. Traditional textile bleaching of natural fibers has involved the use of hydrogen peroxide. Hydrogen peroxide has gained its wide acceptance due to its flexibility of use being capable in both hot and rapid or cold and long dwell bleaching processes and due to its environmental friendliness.

While hydrogen peroxide has gained wide spread acceptance in the textile industry, it is not a particularly effective bleaching agent. Hydrogen peroxide, as commercially supplied, is an extremely stable compound and as a result has only a slight bleaching effect on natural fibers. To overcome its weak activity, extremely high temperatures and/or extremely long bleaching times are required in commercial processes in addition to activation of the peroxide. That is, temperatures in excess of 95° C. are typically required. In addition, activation of the peroxide via the use of alkali, sulfuric acid, uv irradiation, hypochlorite or organic activators is also necessary with alkali being the most preferred. Not only do these drawbacks result in excessive cost associated with commercial textile peroxide bleaching, but the high temperatures and/or long contact times result in significant fiber damage and strength reduction of the resultant yarns and fabrics.

Organic activators have been attempted in textile bleaching systems to little success. Tetra acetyl ethylene diamine or TAED is a common hydrophilic bleach activator widely Ad accepted in the consumer laundry bleaching applications to provide effective bleaching at lower wash temperatures. TAED has been taught in hydrogen peroxide textile bleaching, and in particular in the bleaching of regenerated cellulosics such as rayon. However, while TAED has allowed lower bleaching temperatures, it has proven to provide little advantage in the fiber damage and fiber strength of cellulosics such as rayon. In addition, the poor water solubility of TAED limits its application in textile processing.

Hydrophobic bleach activators, such as nonanoyloxybenzene sulfonate, sodium salt (NOBS) have been employed in consumer laundry detergent applications such as Tide® with Bleach to work in conjunction with peroxygen sources to provide activated bleaching in consumer laundering of garments. Activated bleaching in consumer home laundry conditions allows effective cleaning of certain soils and stains in cold water temperatures. However, the use of hydrophobic systems has been limited in a home consumer laundry environment due to the formation of diacyl peroxides in the wash solution. Diacyl peroxides degrade natural rubber components into which they come in contact. Thus, sump hoses, rubber gaskets, etc in laundry machines have prevented explotation of this technology in certain geographies.

The severe conditions employed in the bleaching of textiles have heretofore prevented the successful application of laundry detergent bleaching technology in textile mill applications. Indeed, EP 584,710 discloses the use of activated bleaching in textile mill applications wherein NOBS is briefly disclosed along with a multitude of other classes and types of activators. While NOBS is disclosed, there is no successful application of hydrophobic bleaching technology where acceptable whiteness values are achieved while damage to fabrics and fibers is minimized. Indeed, EP 584,710 specifies that in order to achieve acceptable whiteness benefits, additional alkali bleaching is necessary which will dramatically increase fiber damage.

Accordingly, the need remains for an effective textile treatment process and in particular for improved hydrogen peroxide bleaching for textile treatment which can provide superior whiteness benefits at reduced bleaching temperatures and times while providing improved fabric strength retention versus conventional textile bleaching processes.

SUMMARY OF THE INVENTION

This need is met by the present invention wherein a method for the treatment of textiles using activated peroxygen bleaching with hydrophobic bleaching systems is provided. The process involves the use of a hydrogen peroxide and a hydrophobic bleach activator or a hydrophobic peracid. The use of a hydrophobic bleaching agent provides superior whiteness and fabric strength and fiber damage benefits, i.e. strength retention to fibers, yarns and fabrics and less fiber damage. In addition, the method of the present invention allows for cost reduction in the operation of a textile bleaching process through the use of significantly lower bleaching temperatures than conventional peroxide bleaching and much shorter processing times, particularly in batch processing.

While not wishing to be bound by theory, it is believed that the hydrophobic bleaching agent of the present invention provide better absorbency on the fabrics and yarns and better "wetting" of the surface of the fibers than conventional peroxide bleaching techniques or hydrophilic activators. Hydrophobic bleach activators form the active bleaching species, peracid, on the surface of the fabric allowing a longer time on the surface of the fabric. Hydrophilic activators, meanwhile, form peracid in solution and must then undergo a fabric solution interaction which is less efficient. As a result, the hydrophobic bleaching agents of the present invention provide superior bleaching and whiteness while minimizing fiber damage and strength reduction.

According to a first embodiment of the present invention, a method for the treatment of non-finished textile components is provided. The method comprises the steps of providing a non-finished textile component such as a fiber, yarn or fabric, saturating the textile component with an aqueous bleaching solution comprising hydrogen peroxide and a hydrophobic bleaching agent such as a hydrophobic activator or a pre-formed hydrophobic peracid, and allowing the bleaching solution to remain in contact with the textile component for a period of time sufficient to bleach the textile component to a CIE whiteness of at least 70.

Preferably, the bleaching solution comprises hydrogen peroxide and a hydrophobic bleach activator which is selected from the group consisting of:

a) a bleach activator of the general formula:

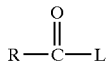

wherein R is an alkyl group having from about 5 to about 17, preferably from about 7 to about 11, carbon atoms and L is a leaving group;

b) a bleach activator of the general formula:

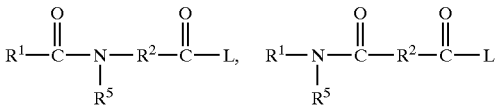

or mixtures thereof, wherein $R^1$ is an alkyl, aryl, or alkaryl group containing from about 1 to about 14 carbon atoms, $R^2$ is an alkylene, arylene or alkarylene group containing from about 1 to about 14 carbon atoms, $R^5$ is H or an alkyl, aryl, or alkaryl group containing from about 1 to about 10 carbon atoms, and L is a leaving group;

c) a benzoxazin-type bleach activator of the formula:

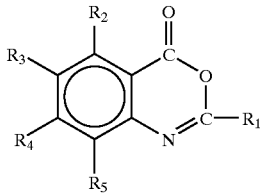

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkylamino, —$COOR_6$, wherein $R_6$ is H or an alkyl group and carbonyl functions;

d) a N-acyl caprolactam bleach activator of the formula:

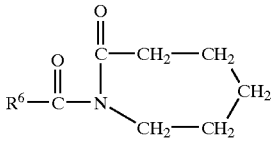

wherein $R^6$ is H or an alkyl, aryl, alkoxyaryl, or alkaryl group containing from 1 to 12 carbons; and e) mixtures of a, b, c and d with the alkanoyloxybenzenesulfonates of the formula:

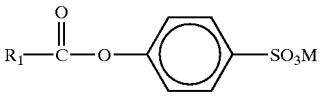

wherein $R_1$ is an alkyl group having from about 7 to 11 carbon atoms and M is a suitable cation being the most preferred hydrophobic activators.

In optional embodiments, the bleaching solution further includes an ingredient selected from the group of wetting agents, sequestering agents, stabilizing agents, desizing agents, scouring agents, detergents and mixtures thereof. Preferred ranges of peroxide and activator are from about 1 g/L to about 20 g/L hydrogen peroxide with a molar ratio of hydrophobic bleach activator to hydrogen peroxide of from about 1:1 to 1:50.

The textile components remain in contact with the bleaching solution at a temperature of from about 20 to about 80° C., preferably from about 50° C. to about 80° C. and for a period of time suitable for whitening the textile component which is typically at least about 15 minutes, more typically from about 15 minutes to about 180 minutes, and even more typically from about 30 to about 60 minutes. In preferred operations, the textile component experiences a fabric strength reduction of less than about 10% and more preferably less than about 5% due to the bleaching of the present invention. Alternatively, the textile component experiences a fluidity increase of less than about 25% repsresenting significantly improved fiber damage.

According to a second embodiment of the present invention, a method for the batch treatment of a non-finished textile woven fabric is provided. This method comprises the steps of:

a) providing an incoming non-finished woven fabric;

b) passing the woven fabric to an aqueous bleaching solution comprising a mixture of hydrogen peroxide and a hydrophobic bleach activator or a pre-formed hydrophobic peracid, heating the bleaching solution to a temperature of from about 20 to about 90° C. and allowing the bleaching solution to contact the fabric for a period of time of from about 15 to about 180 minutes.

Accordingly, it is an object of the present invention to provide a method for the treatment of textile components such as fibers, yams and fabrics which provides superior whiteness on textiles without a significant reduction in fabric strength, and potential fiber damage common to conventional preparation processes. It is another object of the present invention to provide a method for the treatment of textile components employing a hydrophobic bleach activator or pre-formed peracid in conjunction with hydrogen peroxide. These, and other objects, features and advantages of the present invention will be apparent from the following detailed description and the appended claims.

All percentages, ratios and proportions herein are on a 100% weight basis unless otherwise indicated. All documents cited herein are hereby incorporated by reference.

DETAILED DESCRIPTION OF THE PREFERRED EMBODIMENTS

According to the present invention, a superior textile treatment process for fibers, yarns and fabrics, both knitted and woven, is provided. The proper preparation of a textile component such as a fiber, yarn or fabric is critical to the success of further treatment in the manufacture of commercially feasible textile components such as yarns, fabrics, garments, and the like. These treatment steps include dyeing, printing and/or finishing such as application of durable press finishes. Uneven color appearance or impurities such as waxes or oils on the surface of the textile prevent the uniform application of many treatments. Present commercial textile preparation methods, and, in particular, textile bleaching methods, remain unsatisfactory due to the fiber and fabric damage of the treated textiles, high costs associated with the high temperatures necessary to drive bleaching, high costs due to extra equipment necessary for separate treatment steps for de-sizing, scouring and bleaching, environmental unfriendliness due to an excess of toxic salts in the waste.

The present invention provides a cost effective and superior performing alternative to the conventional processing. The present invention involves the use of a hydrophobic bleaching agent such as an activator or peracid in conjunction with peroxide for the bleaching of non-finished textile components. These hydrophobic bleaching species provide superior results in the context of textile whiteness and in fabric strength retention. While conventional textile bleaching processes require high temperatures of more than 95° C. to achieve satisfactory whiteness values of more than 70 on the CIE whiteness index, the result is a degradation of the strength of the fabric of 15% and more of the original fabric strength and a degradation of the fibers of 50% or more, the method of the present invention provides satisfactory whiteness values of more than 70 on the CIE whiteness index while delivering superior fabric strength retention by providing a fabric strength reduction of less than about 10%, more preferably less than about 5% and most preferably less than about 3% from of the original fabric strength. Additionally, the method of the present invention provides a degradation of the fibers of less than 25%, more preferably less than 15% and even more preferably of no more than 10% whereby an increase in degradation represents an increase in fiber damage. Accordingly, the use of the method of the present invention results in a significant reduction in fiber damage as opposed to conventional bleaching technology of peroxide at more than 95° which produces significantly higher degradation. These unique achievements are accomplished due to the lower bleaching temperatures and surface activity possible through the method of the present invention.

In addition, the method of the present invention provides a significant cost advantage through the use of lower bleaching temperatures. In particular, the cost savings in both energy and time in batch type processing via the present invention are significant. Conventional batch processing involves the immersion of the non-finished fabrics in a bleaching solution and heating of the bleaching solution to the effective temperature of more than 95° C. The heating of the fabric and solution to such high temperatures involves a significant investment of both money and time for heating such large quantities. However, due to the lower processing temperatures possible via the present invention, such as from about 50 to about 80° C., the present invention requires significantly less energy and time investment for heating.

The present invention involves the use of an aqueous bleaching solution of hydrogen peroxide and a hydrophobic bleaching species such as a hydrophobic activator or a pre-formed hydrophobic peracid. The hydrogen peroxide or pre-formed peracid is present in the bleaching solution of the present invention at levels of from about 1 to about 20 g/L, more preferably from about 1 to about 10 g/L and most preferably from about 1.5 to about 5 g/L. The hydrophobic activator is then employed at molar ratios of activator to peroxide of from about 1:1 to about 1:50, more preferably from about 1:2 to about 1:30 and even more preferably from about 1:5 to about 1:20. Meanwhile, the ratio of bleaching solution or liquor to the amount of fabric is from about 5:1 to 100:1, more preferably from about 5:1 to about 40:1 and most preferably from about 8:1 to about 20:1.

Particularly useful and preferred is the combination of hydrogen peroxide and hydrophobic bleach activators, and in particular the alkanoyloxy class of bleach activators having the general formula:

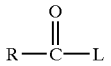

wherein R is an alkyl chain having from about 5 to about 17, preferably from about 7 to about 11 carbon atoms and L can be essentially any suitable leaving group. A leaving group is any group that is displaced from the bleaching activator as a consequence of the nucleophilic attack on the bleach activator by the perhydroxide anion. This, the perhydrolysis reaction, results in the formation of the peroxycarboxylic acid. Generally, for a group to be a suitable leaving group it must exert an electron attracting effect. It should also form a stable entity so that the rate of the back reaction is negligible. This facilitates the nucleophilic attack by the perhydroxide anion.

The L group must be sufficiently reactive for the reaction to occur within the optimum time frame (e.g., a wash cycle). However, if L is too reactive, this activator will be difficult to stabilize for use in a bleaching composition. These characteristics are generally paralleled by the pKa of the conjugate acid of the leaving group, although exceptions to this convention are known. Ordinarily, leaving groups that exhibit such behavior are those in which their conjugate acid has a pKa in the range of from about 4 to about 13, preferably from about 6 to about 11 and most preferably from about 8 to about 11. For the purposes of the present invention, L is selected from the group consisting of:

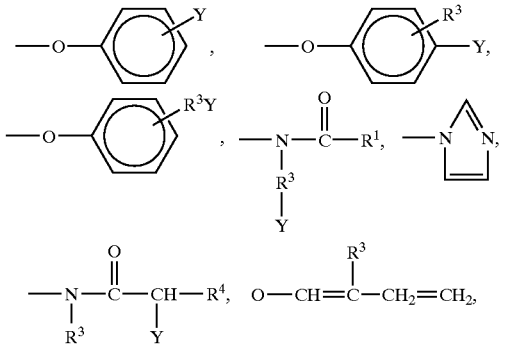

-continued

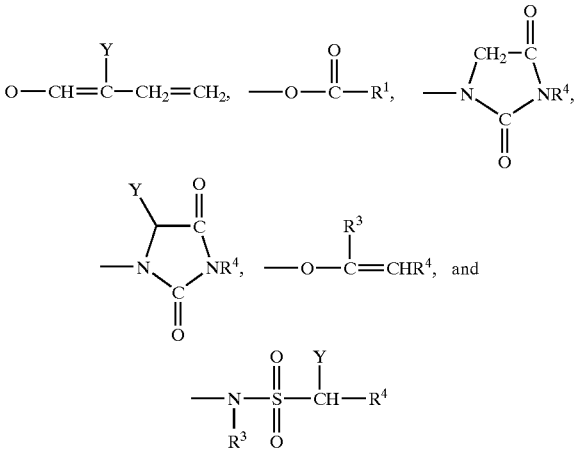

and mixtures thereof, wherein $R^1$ is an alkyl, aryl, or alkaryl group containing from about 1 to about 14 carbon atoms, $R^3$ is an alkyl chain containing from 1 to about 8 carbon atoms, $R^4$ is H or $R^3$, and Y is H or a solubilizing group.

The preferred solubilizing groups are $—SO_3^-M^+$, $—CO_2^-M^+$, $—SO_4^-M^+$, $—N^+(R^3)_4X^-$ and $O<—N(R^3)_3$ and most preferably $—SO_3^-M^+$ and $—CO_2^-M^+$ wherein $R^3$ is an alkyl chain containing from about 1 to about 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion. It should be noted that bleach activators with a leaving group that does not contain a solubilizing groups should be well dispersed in the bleaching solution in order to assist in their dissolution.

Preferred bleach activators are those of the above general formula wherein L is selected from the group consisting of:

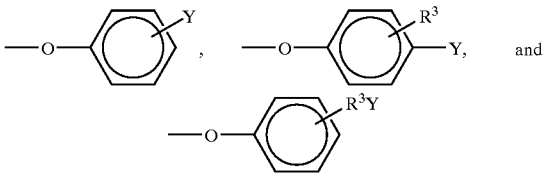

wherein $R^3$ is as defined above and Y is $—SO_3^-M^+$ or $—CO_2^-M^+$ wherein M is as defined above.

Most preferred among the bleach activators of use in the present invention, are alkanoyloxybenzenesulfonates of the formula:

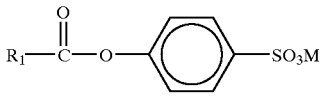

wherein $R_1$ contains from about 7 to about 12, preferably from about 8 to about 11, carbon atoms and M is a suitable cation, such as an alkali metal, ammonium, or substituted ammonium cation, with sodium and potassium being most preferred.

Highly preferred hydrophobic alkanoyloxybenzenesulfonates are selected from the group consisting of nonanoyloxybenzenesulfonate, 3,5,5-trimethylhexanoyloxybenzene-sulfonate, 2-ethylhexandyloxybenzenesulfonate, octanoyloxybenzenesulfonate, decanoyloxybenzenesulfonate, dodecanoyloxybenzenesulfonate, and mixtures thereof.

Alternatively, amido derived bleach activators may be employed in the present invention. These activators are amide substituted compounds of the general formulas:

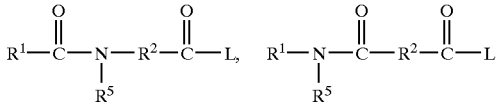

or mixtures thereof, wherein $R^1$ is an alkyl, aryl, or alkaryl group containing from about 1 to about 14 carbon atoms, $R^2$ is an alkylene, arylene or alkarylene group containing from about 1 to about 14 carbon atoms, $R^5$ is H or an alkyl, aryl, or alkaryl group containing from about 1 to about 10 carbon atoms and L is a leaving group as defined above.

Preferred bleach activators are those of the above general formula are wherein $R^1$ is an alkyl group containing from about 6 to about 12 carbon atoms, $R^2$ contains from about 1 to about 8 carbon atoms, and $R^5$ is H or methyl. Particularly preferred bleach activators are those of the above general formulas wherein $R^1$ is an alkyl group containing from about 7 to about 10 carbon atoms and $R^2$ contains from about 4 to about 5 carbon atoms and wherein L is selected from the group consisting of:

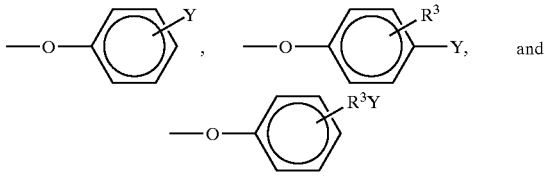

wherein $R^3$ is as defined above and Y is $—SO_3^-M^+$ or $—CO_2^-M^+$ wherein M is as defined above.

Another important class of bleach activators provide organic peracids as described herein by ring-opening as a consequence of the nucleophilic attack on the carbonyl carbon of the cyclic ring by the perhydroxide anion. For instance, this ring-opening reaction in caprolactam activators involves attack at the caprolactam ring carbonyl by hydrogen peroxide or its anion. Since attack of an acyl caprolactam by hydrogen peroxide or its anion occurs preferably at the exocyclic carbonyl, obtaining a significant fraction of ring-opening may require a catalyst. Another example of ring-opening bleach activators can be found in the benzoxazin type activators.

Such activator compounds of the benzoxazin-type, have the formula:

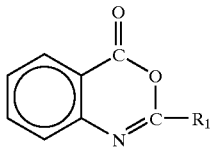

including the substituted benzoxazins of the type

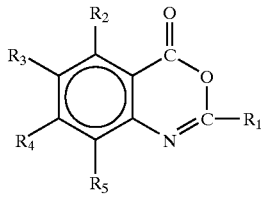

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

A preferred activator of the benzoxazin-type is:

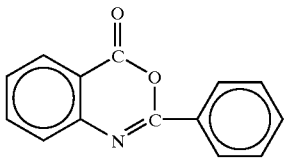

When the activators are used, optimum surface bleaching performance is obtained with washing solutions wherein the pH of such solution is between about 8.5 and 10.5 and preferably between 9.5 and 10.5 in order to facilitate the perhydrolysis reaction.

N-acyl caprolactam bleach activators may be employed in the present invention. These activators have the formula:

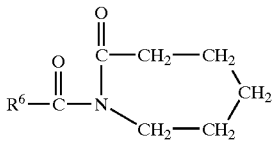

wherein $R^6$ is H or an alkyl, aryl, alkoxyaryl, or alkaryl group containing from 1 to 12 carbons. Caprolactam activators wherein the $R^6$ moiety contains at least about 6, preferably from 6 to about 12, carbon atoms provide hydrophobic bleaching which affords nucleophilic and body soil clean-up, as noted above.

Highly preferred hydrophobic N-acyl caprolactams are selected from the group consisting of benzoyl caprolactam, octanoyl caprolactam, nonanoyl caprolactam, decanoyl caprolactam, undecenoyl caprolactam, 3,5,5-trimethylhexanoyl caprolactam, and mixtures thereof.

Alternatively, a pre-formed peracid may be employed in lieu of the peroxide and activator. The pre-formed hydrophobic peracid are preferably selected from the group consisting of percarboxylic acids and salts, percarbonic acids and salts, perimidic acids and salts, peroxymonosulfuric acids and salts, and mixtures thereof. examples of which are described in U.S. Pat. No. 5,576,282 to Miracle et al.

One class of suitable organic peroxycarboxylic acids have the general formula:

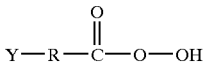

wherein R is an alkylene or substituted alkylene group containing from 1 to about 22 carbon atoms or a phenylene or substituted phenylene group, and Y is hydrogen, halogen, alkyl, aryl, —C(O)OH or —C(O)OOH.

Organic peroxyacids suitable for use in the present invention can contain either one or two peroxy groups and can be either aliphatic or aromatic. When the organic peroxycarboxylic acid is aliphatic, the unsubstituted peracid has the general formula:

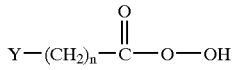

where Y can be, for example, H, $CH_3$, $CH_2Cl$, C(O)OH, or C(O)OOH; and n is an integer from 0 to 20. When the organic peroxycarboxylic acid is aromatic, the unsubstituted peracid has the general formula:

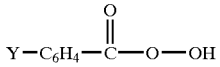

wherein Y can be, for example, hydrogen, alkyl, alkylhalogen, halogen, C(O)OH or C(O)OOH.

Typical monoperoxy acids useful herein include alkyl and aryl peroxyacids such as:

(i) peroxybenzoic acid and ring-substituted peroxybenzoic acid, e.g. peroxy-a-naphthoic acid, monoperoxyphthalic acid (magnesium salt hexahydnate), and o-carboxybenzamidoperoxyhexanoic acid (sodium salt);

(ii) aliphatic, substituted aliphatic and arylalkyl monoperoxy acids, e.g. peroxylauric acid, peroxystearic acid, N-nonanoylaminoperoxycaproic acid (NAPCA), N,N-(3-octylsuccinoyl)aminoperoxycaproic acid (SAPA) and N,N-phthaloylaminoperoxycaproic acid (PAP);

(iii) amidoperoxyacids, e.g. monononylamide of either peroxysuccinic acid (NAPSA) or of peroxyadipic acid (NAPAA).

Typical diperoxyacids useful herein include alkyl diperoxyacids and aryidiperoxyacids, such as:

(iv) 1,12-diperoxydodecanedioic acid;

(v) 1,9-diperoxyazelaic acid;

(vi) diperoxybrassylic acid; diperoxysebacic acid and diperoxyisophthalic acid;

(vii) 2-decyidiperoxybutane-1,4-dioic acid;

(viii) 4,4'-sulfonylbisperoxybenzoic acid.

Such bleaching agents are disclosed in U.S. Pat. No. 4,483,781, Hartman, issued Nov. 20, 1984, U.S. Pat. No. 4,634,551 to Burns et al., European Patent Application 0,133,354, Banks et al. published Feb. 20, 1985, and U.S. Pat. No. 4,412,934, Chung et al. issued Nov. 1, 1983. Sources also include 6-nonylamino-6-oxoperoxycaproic acid as fully described in U.S. Pat. No. 4,634,551, issued Jan. 6, 1987 to Burns et al. Persulfate compounds such as for example OXONE, manufactured commercially by E.I. DuPont de Nemours of Wilmington, Del. can also be employed as a suitable source of peroxymonosulfuric acid.

The bleaching solutions of the present invention may also include various adjunct ingredients. Such ingredients include sequestering or chelating agents, wetting agents, pH control agents, bleach catalysts, stabilizing agents, detergents and mixtures thereof. Wetting agents are typically selected from surfactants and in particular nonionic surfactants. When employed wetting agents are typically included at levels of from about 0.1 to about 10 g/L, more preferably from about 0.1 to about 5 g/L, and more preferably 0.2 to about 1 g/L of the bath. Stabilizing agents are employed for a variety of reasons including buffering capacity, sequestering, dispersing and in addition enhancing the performance of the surfactants. Stabilizing agents are well known with both inorganic or organic species being well known and silicates and organophosphates gaining the broadest acceptance and when present are employed at levels of from about 0 to about 10 g/L, more preferably from about 0.1 to about 5 g/L and most preferably from about 0.1 to about 3 g/L of the bath. In preferred optional embodiments of the present invention, sodium hydroxide is included in the bleaching solution at levels of from about 0.5 to about 20 g/L, more preferably from about 1 to about 10 g/L and most preferably at levels of from about 1.5 to about 5 g/L.

Chelating agents may also be employed and can be selected from the group consisting of amino carboxylates, amino phosphonates, polyfunctionally-substituted aromatic chelating agents and mixtures therein, all as hereinafter defined.

Amino carboxylates useful as optional chelating agents include ethylenediaminetetrace-tates, N-hydroxyethylethylenediaminetriacetates, nitrilotriacetates, ethylenediamine tetrapro-prionates, triethylenetetraaminehexacetates, phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 2-dihydroxy-3,5-disulfobenzenediethylenetriaminepentaacetates, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

When present, chelating agents are employed at levels of from about 0.01 to about 10 g/L, more preferably from about 0.1 to about 5 g/L, and most preferably from about 0.2 to about 2 g/L.

Bleach catalysts may also be employed in the bleaching solutions of the present invention. One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of theses catalysts include $Mn^{IV}_2(u\text{-}O)_3(1,4,7\text{-trimethyl-}1,4,7\text{-triazacyclononane})_2\text{-}(PF_6)_2$ ("MnTACN"), $Mn^{III}_2(u\text{-}O)_1(u\text{-}OAc)_2(1,4,7\text{-trimethyl-}1,4,7\text{-triazacyclononane})_2\text{-}(ClO_4)_2$, $Mn^{IV}_4(u\text{-}O)_6(1,4,7\text{-triazacyclononane})_4(ClO_4)_2$, $Mn^{III}Mn^{IV}_4(u\text{-}O)_1(u\text{-}OAc)_2(1,4,7\text{-trimethyl-}1,4,7\text{-triazacyclononane})_2(ClO_4)_3$, and mixtures thereof. See also European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, and mixtures thereof. For examples of other suitable bleach catalysts herein see U.S. Pat. No. 4,246,612, U.S. Pat. No. 5,227,084 and WO 95/34628, Dec. 21, 1995, the latter relating to particular types of iron catalyst.

See also U.S. Pat No. 5,194,416 which teaches mononuclear manganese (IV) complexes such as $Mn(1,4,7\text{-trimethyl-}1,4,7\text{-triazacyclononane}(OCH_3)_3\text{-}(PF_6)$.

Still another type of bleach catalyst, as disclosed in U.S. Pat. No. 5,114,606, is a water-soluble complex of manganese (II), (III), and/or (IV) with a ligand which is a non-carboxylate polyhydroxy compound having at least three consecutive C-OH groups. Preferred ligands include sorbitol, iditol, dulsitol, mannitol, xylitol, arabitol, adonitol, mesoerythritol, meso-inositol, lactose, and mixtures thereof.

U.S. Pat. No. 5,114,611 teaches another useful bleach catalyst comprising a complex of transition metals, including Mn, Co, Fe, or Cu, with an non-(macro)cyclic ligand. Preferred ligands include pyridine, pyridazine, pyrimidine, pyrdzine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co—, Cu—, Mn—, or Fe— bispyridylmethane and bispyridylamine complexes. Highly preferred catalysts include $Co(2,2'\text{-bispyridylamine})Cl_2$, Di(isothiocyanato) bispyridylamine-cobalt (II), trisdipyridylamine-cobalt(II) perchlorate, $Co(2,2\text{-bispyridylamine})_2O_2ClO_4$, Bis-(2,2'-bispyridylamine) copper(II) perchlorate, tris(di-2-pyridylamine) iron(II) perchlorate, and mixtures thereof Other bleach catalyst examples include Mn gluconate, $Mn(CF_3SO_3)_2$, $Co(NH_3)_5Cl$, and the binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]\text{-}(ClO_4)_3$.

Particularly preferred manganese catalyst for use herein are those which are fully disclosed in WO 98/23249, WO 98/39098, WO 98/39406 and WO 98/39405, the disclosures of which, are herein incorporated by reference.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Preferred are cobalt (III) catalysts having the formula:

$$Co[(NH_3)_nM'_mB'_bT'_tQ_qP_p]Y_y$$

wherein cobalt is in the +3 oxidation state; n is an integer from 0 to 5 (preferably 4 or 5; most preferably 5); M' represents a monodentate ligand; m is an integer from 0 to 5 (preferably 1 or 2; most preferably 1); B' represents a bidentate ligand; b is an integer from 0 to 2; T' represents a tridentate ligand; t is 0 or 1; Q is a tetradentate ligand; q is 0 or 1; P is a pentadentate ligand; p is 0 or 1; and n+m+2b+3t+4q+5p=6; Y is one or more appropriately selected present in a number y, where y is an integer from 1 to 3 (preferably 2 to 3; most preferably 2 when Y is a −1 charged anion), to obtain a charge-balanced salt, preferred Y are selected from the group consisting of chloride, nitrate, nitrite, sulfate, citrate, acetate, carbonate, and combinations thereof; and wherein further at least one of the coordination sites attached to the cobalt is labile under automatic dishwashing use conditions and the remaining coordination sites stabilize the cobalt under automatic dishwashing conditions such that the reduction potential for cobalt (III) to cobalt (II) under alkaline conditions is less than about 0.4 volts (preferably less than about 0.2 volts) versus a normal hydrogen electrode. Some preferred catalysts are the chloride salts having the formula $[Co(NH_3)_5Cl]Y_y$, and especially $[Co(NH_3)_5Cl]Cl_2$.

More preferred are the present invention compositions which utilize cobalt (III) bleach catalysts having the formula:

$$[Co(NH_3)_n(M)_m(B)_b]T_y$$

wherein cobalt is in the +3 oxidation state; n is 4 or 5 (preferably 5); M is one or more ligands coordinated to the cobalt by one site; m is 0, 1 or 2 (preferably 1); B is a ligand coordinated to the cobalt by two sites; b is 0 or 1 (preferably 0), and when b=0, then m+n=6, and when b=1, then m=0 and n=4; and T is one or more appropriately selected counter-anions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}$ $s^{-1}$ (25° C.). These materials are more fully disclosed in U.S. Pat. Nos. 5,559,261, 5,597,936, 5,705,464, 5,703,030 and 5,962,386 the disclosures of which are herein incorporated by reference.

As a practical matter, and not by way of limitation, the solutions herein can be adjusted to provide on the order of at least one part per hundred million of the active bleach catalyst species in the aqueous medium, and will preferably provide from about 0.01 ppm to about 25 ppm, more preferably from about 0.05 ppm to about 10 ppm, and most preferably from about 0.1 ppm to about 5 ppm, of the bleach catalyst species in the liquor.

Also useful herein are any of the known organic bleach catalysts, oxygen transfer agents or precursors therefor. These include the compounds themselves and/or their precursors, for example any suitable ketone for production of dioxiranes and/or any of the hetero-atom containing analogs of dioxirane precursors or dioxiranes, such as sulfonimines $R^1R^2C{=}NSO_2R^3$, see EP 446 982 A, published 1991 and sulfonyloxaziridines, for example:

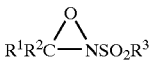

see EP 446,981 A, published 1991. Preferred examples of such materials include hydrophilic or hydrophobic ketones, used especially in conjunction with monoperoxysulfates to produce dioxiranes in situ, and/or the imines described in U.S. Pat, No. 5,576,282 and references described therein. Oxygen bleaches preferably used in conjunction with such oxygen transfer agents or precursors include percarboxylic-acids and salts, percarbonic acids and salts, peroxymonosulfuric acid and salts, and mixtures thereof. See also U.S. Pat. Nos. 5,360,568; 5,360,569; and 5,370,826. In a highly preferred embodiment, the invention relates to a detergent composition which incorporates a transition-metal bleach catalyst in accordance with the invention, and organic bleach catalyst such as one named hereinabove.

The method of the present invention involves providing a non-finished textile component into the bleaching solution as described. The textile component may comprise fibers, yarns and fabrics including wovens, nonwovens and knits. By non-finished, it is intended that the textile component be a material that has not been dyed, printed, or otherwise provided a finishing step such as durable press finish. Of course, one of ordinary skill in the art will recognize that the textile component of the present invention are those that have not been passed through a garment or other manufacturing process involving cutting and sewing of the material.

The present process may be employed with most any natural material including cellulosics such as cotton, linen and regenerated cellulosics such as rayon and lyocell. Both 100% natural fibers, yarns and fabrics may be employed or blends with synthetic materials may be employed as well. For the purposes of the present invention, natural fibers may include cellulosics as described herein, wools both pure and blends, silks, sisal, flax and jute.

The method of the present invention may include the further steps of singeing, de-sizing, scouring, and mercerization in conjunction with the bleaching step. These steps may be performed in various combinations and orders and one of ordinary skill in the art will recognize that varying combinations are possible. The de-sizing step of the present invention involves the removal of sizing agents such as starch and polyvinyl alcohol added to fibers during weaving of yarns. The de-sizing step involves the use of an aqueous solution of amylase enzymes and typically wetting agents and salts and soaking or contacting the fabrics with the enzymatic solution of a time sufficient to remove the sizing agents.

The scouring step of the present invention involves the removal of natural or synthetic impurities from the textiles such as waxes and oils. The scouring step involves the use of an aqueous alkaline bath, typically sodium hydroxide at elevated temperatures. Optional ingredients in the alkaline bath include wetting agents and chelating agents.

The mercerization step of the present invention involves the application of high concentrations of alkali such as sodium hydroxide in conjunction with stretching and pulling of the textiles to restore fiber strength and improve luster while singeing involves passing the textiles over an open flame to remove loose fibers or strands. De-sizing, scouring, mercerization and singeing are well known to one of ordinary skill in the art and will be well recognized and within the level of skill of the artisan.

Of course the process of the present invention includes in the preferred applications a washing step or series of washing steps following the method of the present invention. Washing of treated textiles is well known and within the level of skill of the artisan. Washing stages will be typically present after each of the de-sizing, scouring and mercerization step when present as well as after the bleaching step of the present invention. In addition, the bleaching and de-sizing scouring or mercerization steps when present may in preferred embodiments include a wet-out or pre-wetting step to ensure even or uniform wettness in the textile component.

The method of the present invention provides superior wettability to textile components treated via the method. Wettability of the textiles is important to any dyeing and finishing of the textiles. Wettability leads to superior penetration of the textile by the dye or finish agents and a superior dye and/or finishing result. Accordingly, the wettability of the textile is an indication of how effective the treatment process has been. Higher wettability means a more effective and superior treatment process, i.e. a shorter period of time for wetting. Conventional textile peroxygen bleaching has provided acceptable wetting profiles only at temperature in excess of 95° C. while lower temperature bleaching (70° C.) results in wettability profiles more than about 40%. However, the process of the present invention provides fabrics that have a increase in the wettability index of less than about 10% preferably less than about 5% where the wettability index is defined as:

$$\frac{(\text{wettability at } 70^\circ \text{ C.}) - (\text{wettability at } 95^\circ \text{ C.})}{(\text{wettability at } 95^\circ \text{ C.})}$$

in percent.

For purposes of the present invention, fiber degradation or damage is based on fluidity as measured via AATCC test method 82-1996 involving the dispersion of the fibers in cupriethylene diamine (CP). An increase in fluidity between treated fibers and non-treated fibers represents an increase in the amount of fiber damage. The method employed is outlined as follows. A representative sample of fibers of about 1.5 mm is cut and dissolved in CP as defined by the equation CP=120×sample weight×0.98 in a specimen bottle with several glass balls, placed under nitrogen. The bottle is shaken for approximately 2 hours. Additional CP is added as defined by the equation CP=80×sample weight×0.98 followed by additional shaking under nitrogen for three hours. Following dissolution, the solution is placed under constant stirring to prevent separation of the dispersion. The solution is then measured in a calibrated Oswald Canon Fenske viscometer in a constant temperature bath of 25° C. to determine the efflux time. Efflux time is determined by drawing the fluid to a mark between 2 bulbs and measuring the time required for the meniscus to pass from the mark between the bulbs to the mark below the lower bulb. The average of two times is used. Fluidity is then calculated from the formula F=100/ctd, where c=viscometer constant, t=efflux time and d=density of the solution 1.052.

The following non-limiting examples further illustrate the present invention.

EXAMPLE 1

A process for the bleaching and preparation according to the present invention may be conducted in the following manner. The process may be carried out in a automatic lab dyeing machine with an infrared heating system (Labmat) made by Mathis Co. The bleaching bath was prepared by adding the chemicals as outlined in Table I below to de-ionized water. The addition sequence was as follows: Wetting agent-Chelating agent-Activator-$H_2O_2$—NaOH-Fabric. The fabric was a de-sized and scoured 100% cotton print cloth, plain woven with 122 g/m$^2$ weight. The original fabric whiteness was 32.58 on the CIE scale. With a liquor/fabric ratio of 15:1, the fabric was put into the solution. The solution was heated from about 20° C. to required bleaching temperature per Table I in about 10 min, kept at the required temperature for 50 min, and then cooled down to the room temperature. The fabric was removed from the bleaching solution and washed completed with hot water and warm water to ensure no residual alkali remained on the fabric. The fabric was dried and conditioned under 70° F. and 65% relative humidity for wetting and whiteness measurements. Miniscan XE Plus made by HunterLab was used to measure CIE Whiteness Index. An Instron was used to evaluate the fabric strength by following the method ASTM D 5035. The fabric wettability was measured by AATCC Test Method 79-1995. The less wetting time, the better fabric wettability or absorbency.

TABLE I

| | A | B | C | D |
|---|---|---|---|---|
| Temp (° C.) | 70 | 70 | 70 | 95 |
| NaOH (g/l) | 3.5 | 3.5 | 3.5 | 3.5 |
| $H_2O_2$ (g/l) | 2 | 2 | 2 | 2 |
| Activator | None | Hydrophobic[1] | Hydrophilic[2] | None |
| Molar Ratio (Activator/ $H_2O_2$) | — | 1:10 | 1:10 | — |
| Stabilizer (g/l) | — | — | — | — |
| Wetting Agent[3] (g/l) | 0.7 | 0.7 | 0.7 | 0.7 |
| Chelating Agent[4] (g/l) | 0.3 | 0.3 | 0.3 | 0.3 |
| Time (min) | 50 | 50 | 50 | 50 |
| Liquor/Fabric Ratio | 15:1 | 15:1 | 15:1 | 15:1 |
| Wettability (sec.) | 1.92 | 1.42 | 1.47 | 1.34 |
| CIE Whiteness | 64.4 | 73.7 | 68.5 | 75.8 |
| Fabric Strength (Newtons) | 232.1 | 248.6 | 220.2 | 211.6 |
| Strength Reduction (%) | 7.5 | 0.9 | 12.2 | 15.3 |

[1]nonanoyloxybenezene sulfonate, sodium salt, NOBS.
[2]tetra acetyl ethylene diamine, TAED.
[3]Silvatrol SL from Ciba Geigy.
[4]Invatek DTPA-41 from Ciba Geigy

What is claimed is:

1. A method for the preparation of a non-finished textile component comprising the steps of providing a non-finished textile component, saturating said textile component with an aqueous bleaching solution comprising hydrogen peroxide and a hydrophobic bleaching agent selected from the group consisting of bleach activator and pre-formed peracid and allowing said bleaching solution to remain in contact with said textile component for a period of time sufficient to bleach said textile component wherein the resultant treated textile component has a whiteness value on the CIE index of at least about 70 or a fiber degradation increase of less than about 25%.

2. The method as claimed in claim 1 wherein said bleaching solution comprises hydrogen peroxide and a hydrophobic bleach activator selected from the group consisting of:

a) a bleach activator of the general formula:

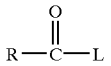

wherein R is an alkyl chain having from about 5 to about 17 carbon atoms and L is a leaving group:

b) a bleach activator of the general formula:

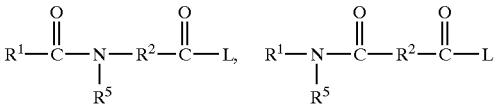

or mixtures thereof, wherein $R^1$ is an alkyl, aryl, or alkaryl group containing from about 1 to about 14 carbon atoms, $R^2$ is an alkylene, arylene or alkarylene group containing from about 1 to about 14 carbon atoms, $R^5$ is H or an alkyl, aryl, or alkaryl group containing from about 1 to about 10 carbon atoms, and L is a leaving group;

c) a benzoxazin-type bleach activator of the formula:

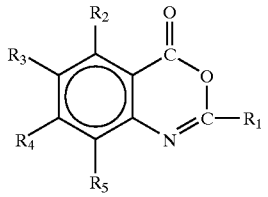

wherein $R_1$ is H, alkyl, alkaryl, aryl, or arylalkyl, and wherein $R_2$, $R_3$, $R_4$, and $R_5$ may be the same or different substituents selected from the group consisting of H, halogen, alkyl, alkenyl, aryl, hydroxyl, alkoxyl, amino, alkylamino, —$COOR_6$, wherein $R_6$ is H or an alkyl group, and carbonyl;

d) a N-acyl caprolactam bleach activator of the formula:

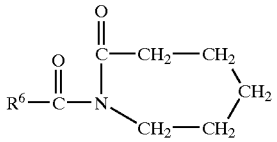

wherein $R^6$ is H or an alkyl, aryl, alkoxyaryl, or alkaryl group containing from 1 to 12 carbons; and e) mixtures of a, b, c and d.

3. The method as claimed in claim 2 wherein said hydrophobic bleach activator is a bleach activator selected from the general formula:

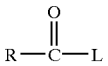

wherein R is an alkyl chain having from about 7 to about 12 carbon atoms and L is a leaving group, the conjugate acid of which has a pKa from about 4 to about 13.

4. The method as claimed in claim 3 wherein said bleach activator is an alkanoyloxybenzenesulfonate of the formula:

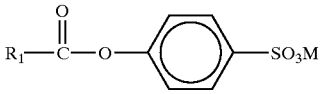

wherein $R_1$ is an alkyl group having from about 7 to about 11 carbon atoms and M is a suitable cation.

5. The method as claimed in claim 1 wherein said bleaching solution further includes an ingredient selected from the group consisting of wetting agents, sequestering agents, stabilizing agents, desizing agents, scouring agents and mixtures thereof.

6. The method as claimed in claim 2 wherein said bleaching solution contains from about 1 to about 20 g/L of hydrogen peroxide.

7. The method as claimed in claim 2 wherein the molar ratio of hydrophobic bleach activator to hydrogen peroxide in said bleaching solution ranges from about 1:1 to about 1:50.

8. The method as claimed in claim 1 wherein said textile component remains in contact with said bleaching solution for from about 15 to about 180 minutes.

9. The method as claimed in claim 8 wherein said bleaching solution is at a temperature of from about 20 to about 90° C.

10. The method as claimed in claim 7 wherein said bleaching solution is at a temperature of from about 50 to about 80° C. and said textile component remains in contact with said bleaching solution for from about 30 to about 60 minutes.

11. The method as claimed in claim 1 wherein said bleaching solution further comprises from about 0.5 to about 20 g/L of sodium hydroxide.

12. The method as claimed in claim 7 wherein the ratio of said bleaching solution to said textile component is from about 5:1 to about 100:1.

13. The method as claimed in claim 1 wherein said textile component experiences a fabric strength reduction of less than about 10% during said method.

14. The method as claimed in claim 11 wherein said treated textile component experiences a fiber degradation increase of less than about 25%.

15. The method as claimed in claim 1 further comprising the step of de-sizing said non-finished textile component prior to contact with said bleaching solution.

16. The method as claimed in claim 1 further comprising the step of scouring said non-finished textile component prior to contact with said bleaching solution.

17. A method for the batch preparation of a woven textile fabric comprising the steps of:

a) providing an incoming non-finished woven fabric;

b) passing said fabric to an aqueous bleaching solution, said bleaching solution comprising a mixture of hydrogen peroxide and a hydrophobic bleach activator or a preformed hydrophobic activator, heating said bleaching solution to a temperature of from about 20 to about 90° C. and allowing said bleaching solution to contact said fabric for a period of time of from about 15 to about 180 minutes.

18. The method as claimed in claim 17 wherein said bleach activator is an alkanoyloxybenzenesulfonate of the formula:

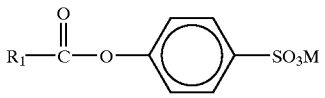

wherein $R_1$ has from about 5 to about 17 carbon atoms and M is a suitable cation.

19. The method as claimed in claim 17 wherein said bleaching solution further includes an ingredient selected from the group of wetting agents, sequestering agents, stabilizing agents, de-sizing agents, scouring agents and mixtures thereof.

20. The method as claimed in claim 17 wherein said bleaching solution is at a temperature of from about 50 to about 80° C. and said textile component remains in contact with said bleaching solution for from about 30 to about 60 minutes.

21. The method as claimed in claim 17 wherein said bleaching solution contains from about 1 to about 20 g/L of hydrogen peroxide.

22. The method as claimed in claim 17 wherein the molar ratio of hydrophobic bleach activator to hydrogen peroxide in said bleaching solution ranges from about 1:1 to about 1:50.

23. The method as claimed in claim 17 wherein said textile component remains in contact with said bleaching solution for from about 30 to about 60 minutes.

24. The method as claimed in claim 17 wherein said bleaching solution is at a temperature of from about 50 to about 80° C.

25. The product produced by the process of claim 1.

26. The product produced by the process of claim 17.

27. A substrate comprising a collection of non-finished bleached textile components wherein said substrate has a whiteness value on the CIE index of greater than about 70 and has experienced a fabric strength reduction of less than about 10%.

28. The substrate as claimed in claim 27 wherein said treated textile component experiences a fiber degradation increase of less than about 25%.

29. The substrate as claimed in claim 27 wherein said substrate has a wettability index of less than about 10%.

30. A method for improving the wettability loss of textile components comprising the steps of:

a) providing an incoming non-finished woven fabric;

b) passing said fabric to an aqueous bleaching solution, said bleaching solution comprising a mixture of hydrogen peroxide and a hydrophobic bleach activator or a pre-formed hydrophobic activator, heating said bleaching solution to a temperature of from about 20 to about 90° C. and allowing said bleaching solution to contact said fabric for a period of time of from about 15 to about 180 minutes.

31. The method as claimed in claim 1 wherein said resultant treated textile component has a whiteness value on the CIE index of greater than about 70.

32. The method as claimed in claim 1 wherein said non-finished textile component fibers are selected from the group consisting of cotton, linen, jute, wool, silk, rayon, lyocell and combinations thereof.

* * * * *